US006481114B1

(12) United States Patent
Kalajian

(10) Patent No.: US 6,481,114 B1
(45) Date of Patent: Nov. 19, 2002

(54) FINGER RING SHIM AND SIZING TOOL

(76) Inventor: Nazaret Kalajian, 8606 Stable Crest, Houston, TX (US) 77024

( * ) Notice: Subject to any disclaimer, the term of this patent is extended or adjusted under 35 U.S.C. 154(b) by 0 days.

(21) Appl. No.: 09/918,349

(22) Filed: Jul. 30, 2001

(51) Int. Cl.[7] ..... G01B 3/34; A44C 9/02

(52) U.S. Cl. ..... 33/555.3; 33/512; 33/544.4; 33/514.1; 63/15.6

(58) Field of Search ..... 33/512, 514.1, 33/542, 544.4, 555.1, 501.45, 543, 546, 551, 549, 555.3, 550; 63/15.6, 15

(56) References Cited

U.S. PATENT DOCUMENTS

| | | | | | |
|---|---|---|---|---|---|
| 235,507 | A | * | 12/1880 | Chapman | 33/514.1 |
| 500,130 | A | * | 6/1893 | Hughes | 33/514.1 |
| 524,589 | A | * | 8/1894 | Gruebel | 33/514.1 |
| 1,382,043 | A | * | 6/1921 | Young | 63/15.6 |
| 1,634,378 | A | * | 7/1927 | Mountford | 33/514.1 |
| 3,193,941 | A | * | 7/1965 | Hoffman | 33/514.1 |
| 3,460,356 | A | * | 8/1969 | Lodrini | 63/15.6 |
| 3,465,544 | A | * | 9/1969 | Tucker | 63/15.6 |
| 3,483,717 | A | * | 12/1969 | Mayer | 63/15.6 |
| 3,483,718 | A | * | 12/1969 | Lodrini | 63/15.6 |
| 3,639,995 | A | * | 2/1972 | Gardner | 33/514.1 |
| 3,822,476 | A | * | 7/1974 | Leveridge | 33/514.1 |
| 3,835,664 | A | * | 9/1974 | Nesbit | 63/15.6 |
| 4,526,016 | A | * | 7/1985 | Cercone | 63/15.6 |
| 4,538,430 | A | * | 9/1985 | Parks | 63/15.6 |
| 4,964,222 | A | * | 10/1990 | Keener | 33/514.1 |
| 5,261,256 | A | * | 11/1993 | Ellenbecker et al. | 63/15.6 |
| 5,269,069 | A | * | 12/1993 | Min | 33/514.1 |
| 5,353,513 | A | * | 10/1994 | Round | 33/514.1 |
| 5,628,208 | A | * | 5/1997 | Rood | 63/15.6 |
| 6,253,459 | B1 | * | 7/2001 | Barnhil | 33/514.1 |
| 6,279,244 | B1 | * | 8/2001 | Kelley | 33/514.1 |
| 6,192,708 | B1 | * | 2/2002 | Mitchell | 63/15.6 |

FOREIGN PATENT DOCUMENTS

| | | | | |
|---|---|---|---|---|
| JP | 55101801 | * | 8/1980 | 33/542 |
| JP | 63071601 | * | 4/1988 | 33/514.1 |
| JP | 02257002 | * | 10/1990 | 33/555.1 |
| JP | 04047201 | * | 2/1992 | 33/514.1 |

* cited by examiner

*Primary Examiner*—Diego Gutierrez
*Assistant Examiner*—Travis Reis
(74) *Attorney, Agent, or Firm*—Jack Lo

(57) ABSTRACT

A finger ring shim is comprised of a member for being wedged between a loose ring and a finger. A groove on the member is arranged for cradling the ring. The groove has a width which is selected to receive a ring of a particular thickness. The member has a shim thickness which is selected to match a gap size between the ring and the finger. A tool for determining the proper groove width and shim thickness is comprised of an elongated and tapered sheet with a scale along an edge, and slots of graduated widths. The sheet is inserted between a finger and a ring until it is snug. The point on the scale under the ring is correlated with a suitable shim thickness, and the smallest slot which the ring can fit into shows the suitable groove width.

5 Claims, 3 Drawing Sheets

FINGER RING SHIM AND SIZING TOOL

BACKGROUND OF THE INVENTION

1. Field of the Invention

This invention relates generally to finger rings.

2. Prior Art

As shown in FIG. 1, an arthritic hand 10 has fingers 11 with enlarged joints 12. A ring 13 for an arthritic hand must be wide enough to pass around the largest joint on the ring finger. However, the ring would be much too loose when in position on the finger.

OBJECTIVES OF THE INVENTION

The objectives of the present finger ring shim and sizing tool are:

to secure a ring on a finger with enlarged joints; and to provide a tool for determining the suitable shim thickness and width.

Further objectives of the present invention will become apparent from a consideration of the drawings and ensuing description.

BRIEF SUMMARY OF THE INVENTION

A finger ring shim is comprised of a member for being wedged between a loose ring and a finger. A groove on the member is arranged for cradling the ring. The groove has a width which is selected to receive a ring of a particular thickness. The member has a shim thickness which is the distance between the bottom of the groove and the inner side of the elongated member, and is selected to match a gap size between the ring and the finger. A tool for determining the proper groove width and shim thickness is comprised of an elongated and tapered sheet with a scale along an edge, and slots of graduated widths. The sheet is inserted between the ring and the finger until it is snug. The point on the scale under the ring is correlated with a suitable shim thickness, and the smallest slot which the ring can fit into indicates the suitable groove width.

DRAWING REFERENCE NUMERALS

10. Hand
11. Finger
12. Enlarged Joint
13. Ring

14. Shim Sizing Tool
15. Sheet
16. Scale
17. Edge
18. Marks
19. Slot
20. Slot
21. Slot
22. Slot
23. Slot
24. Shim
25. Member
26. Groove
27. Outer Side
28. Wall
29. Bottom of Groove
30. Inner Side
31. Member

DETAILED DESCRIPTION OF THE INVENTION

Figure 1:
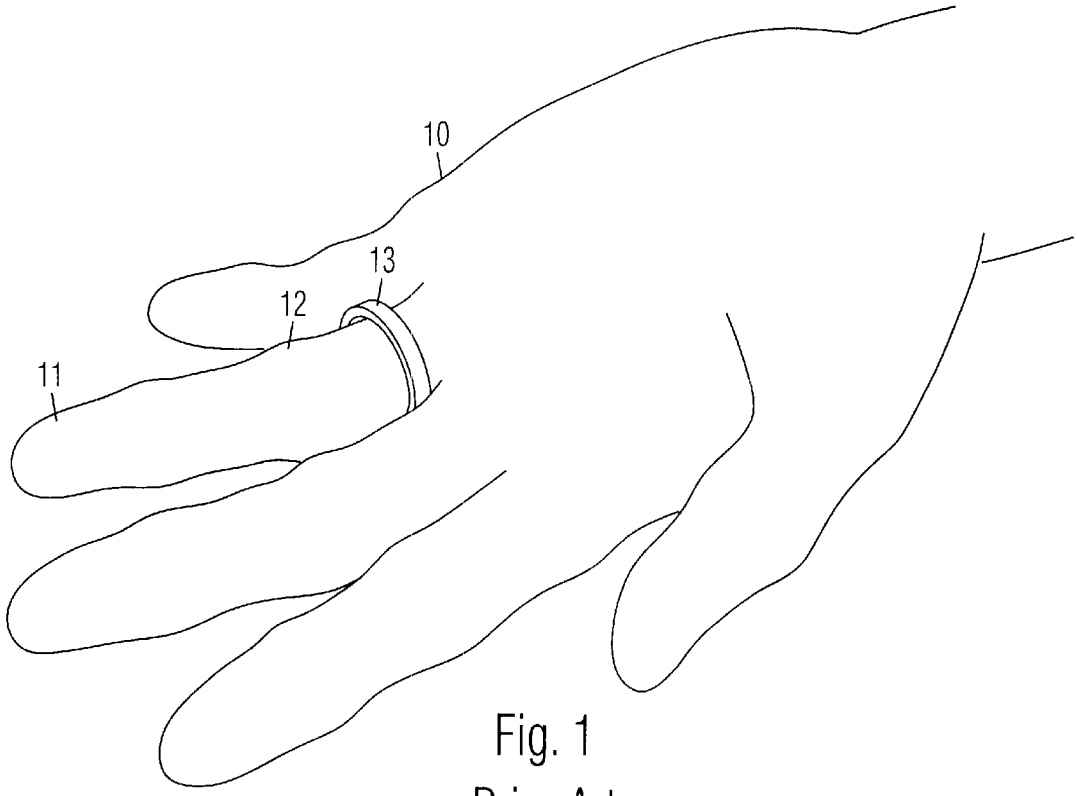
Fig. 1 Prior Art
FIG. 1 is a perspective view of a prior art ring on a finger with enlarged joints.
Figure 2:
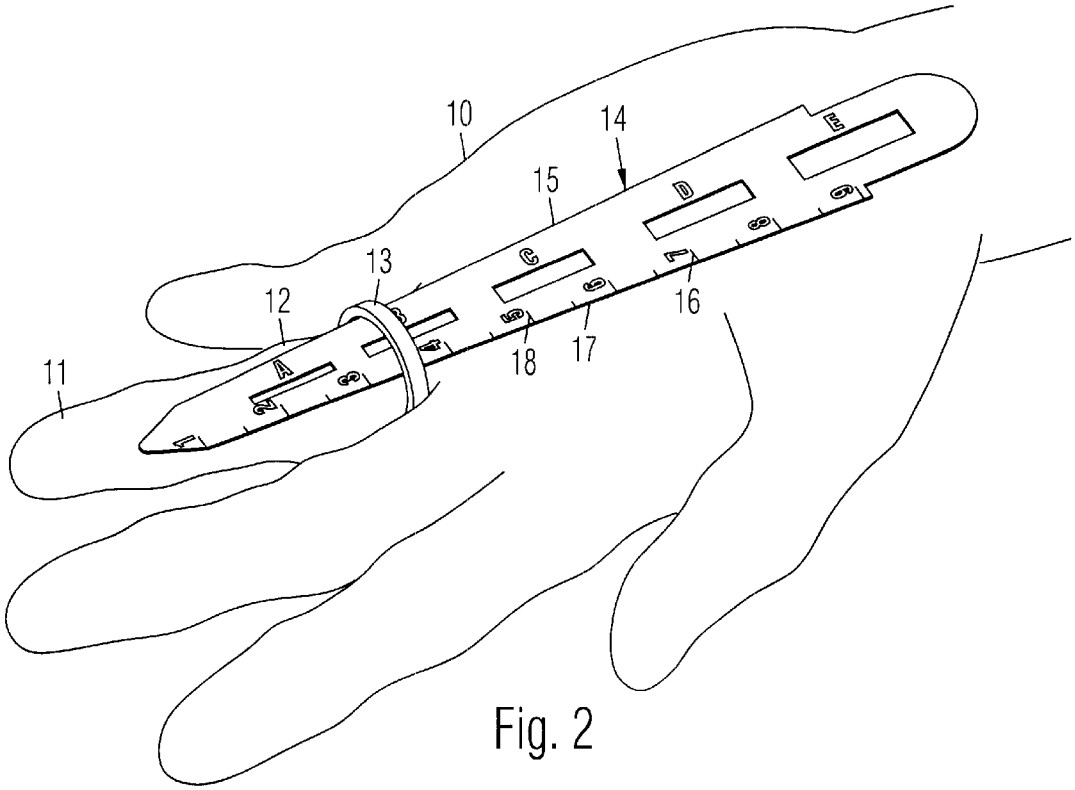
FIG. 2 is a perspective view of the present shim sizing tool measuring the gap size under the ring.

FIG. 2:

A finger ring 13 which is loose on a finger 11 with enlarged arthritic joints 12 is measured by the present shim sizing tool 14 in FIG. 2. Tool 14 is comprised of an elongated and tapered sheet 15 with a scale 16 along an edge 17. Marks 18 along scale 16 are correlated with different gap sizes between different rings and fingers. When ring 13 is in a wearing position, sheet 15 is inserted between ring 13 and finger 12 until it is snug. The mark 18 on scale 16 directly under ring 13 is correlated with the actual gap size and thus a suitable shim thickness. As an example, arbitrary numerals from 1–9 are marked along scale 16 to represent different actual gap sizes. If each major division on scale 16 represents a 0.5 millimeter gap, the position shown in FIG. 2 presents a gap size and thus a shim thickness of 1.75 mm. Alternatively, each division may represent a different actual gap size, and scale 16 may be marked with actual gap sizes in inch or millimeter instead of arbitrary numerals.

Figure 3:
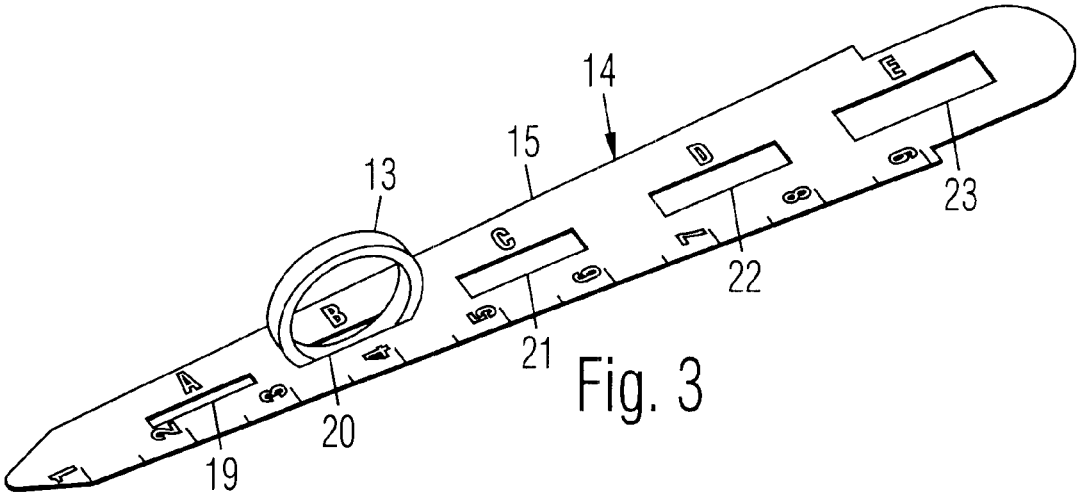
FIG. 3 is a perspective view of the shim sizing tool measuring the ring thickness.
Figure 4:
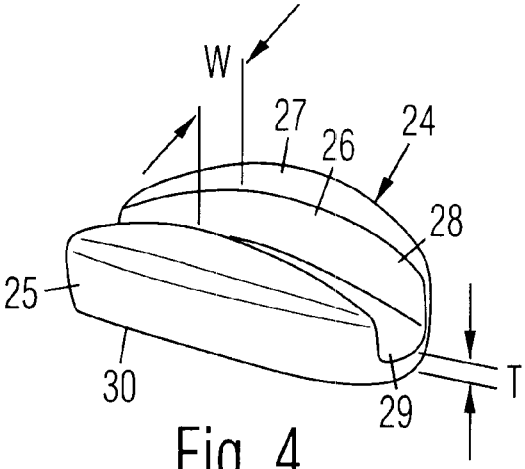
FIG. 4 is a perspective view of the present finger ring shim.

FIG. 3:

Ring 13 is shown in FIG. 3 being measured by shim sizing tool 14 for its width. Slots 19–23 of graduated widths are provided on sheet 15. Ring 13 is inserted edgewise into different slots to find the smallest slot which ring 13 can slip into. If ring 13 is wider at the top, for example, where a jewel may be attached, then the bottom of ring 13 should be measured. As an example, slots 19–23 are marked with arbitrary letters from A–E to represent corresponding actual ring widths from 2–6 mm. Alternatively, slots 19–23 may be marked with different arbitrary letters or numerals, or actual widths in inch or millimeter. Shim sizing tool 14 may be used by a jeweler in a jewelry store, or it may be mailed to a customer for her to take the measurements at home.

Figure 5:
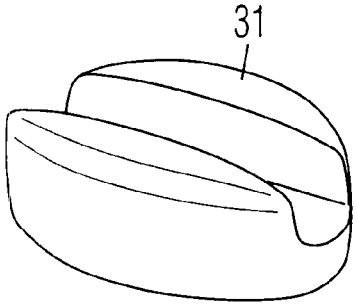
FIG. 5 is a perspective view of an alternative embodiment of the finger ring shim.

FIGS. 4–5:

The present finger ring shim 24 is comprised of an elongated member 25 for being wedged between a loose ring and an arthritic finger with enlarged joints. Member 25 is preferably oval or elliptical for comfort, but it may be of other shapes. A groove 26 on an outer side 27 of member is arranged for cradling the ring. Groove 26 has a width W which is the distance between its opposite walls 28, and is selected to receive a ring of a particular thickness. Member 25 has a shim thickness T which is the distance between a bottom 29 of groove and an inner side 30 of elongated member 25, and is selected to match a gap size between the ring and the finger. In this example, inner side 30 of member 25 is curved to conform to a contour of the finger, but a flat member 31 as shown in FIG. 5 may be used instead, particularly when the finger is wide. A plurality of shims may be provided and selected for individual users as necessary. For example, shims for each ring width may be provided in a range of thickness to cover many possible combinations of ring widths and gap sizes.

Figure 6:
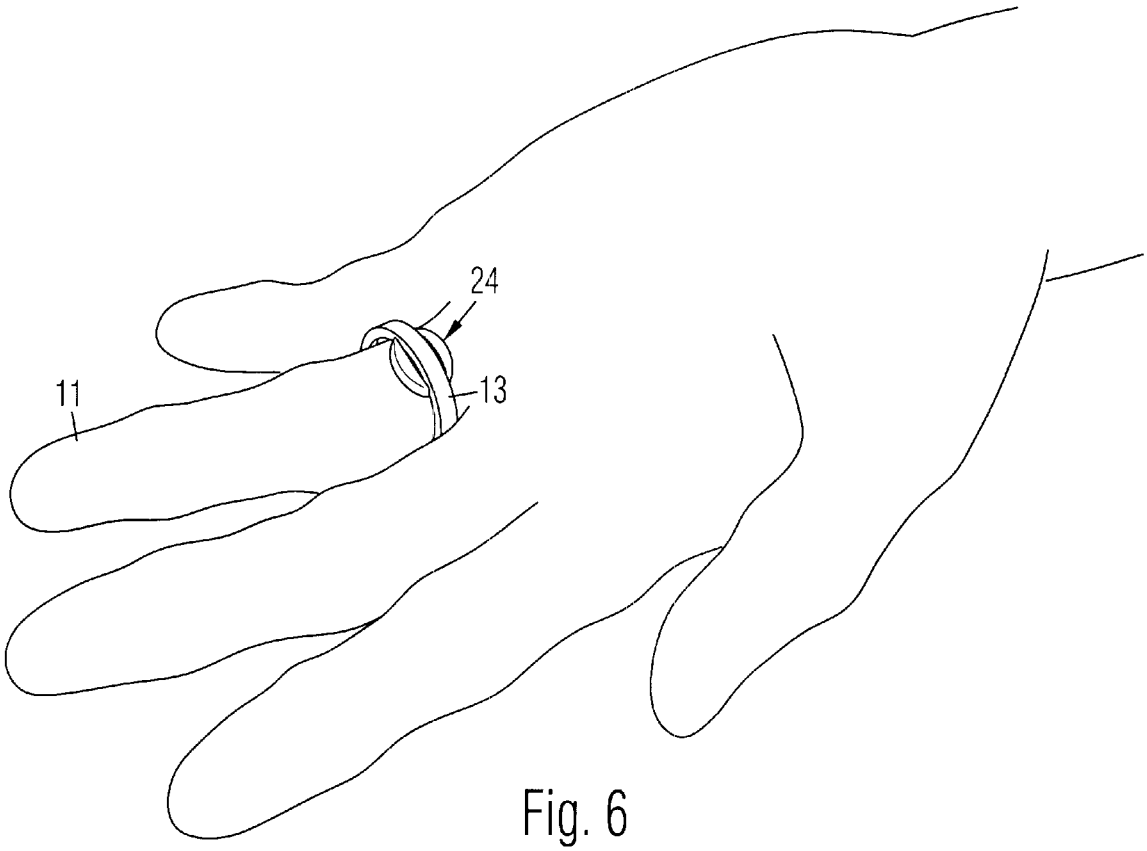
FIG. 6 is a perspective view of the shim wedged between the ring and the finger.
Figure 7:
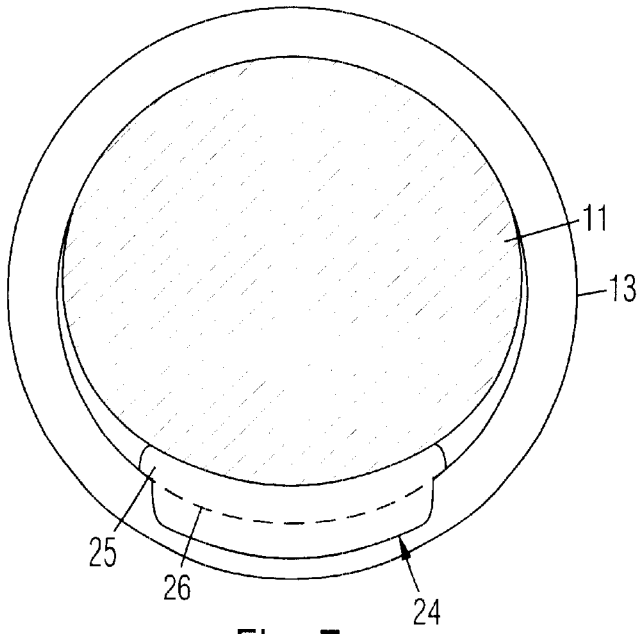
FIG. 7 is a sectional view of the finger showing the shim under the ring.

FIG. 6–7:

A suitably sized shim 24 is wedged between ring 13 and finger 11 in FIGS. 5–6 to make ring 13 snug on finger 11. Ring 13 is received in groove 26 on member 25. Shim 24 is preferably worn on the inner side of finger 11 to make it inconspicuous.

SUMMARY AND SCOPE

Accordingly, the present finger ring shim is usable for securing an otherwise loose ring on a finger with enlarged joints, and the present sizing tool is usable for determining the suitable shim thickness and width.

Although the foregoing description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. A finger ring shim system, comprising:

a shim comprising an elongated member for being wedged between a loose finger ring and a finger; and a groove on an outer side of said member for cradling said ring, wherein said shim has a groove width selected for cradling said ring, and a shim thickness which is a distance between a bottom of said groove and an inner side of said elongated member, said shim thickness being selected for generally matching a gap size between said ring and said finger; and a shim sizing tool for determining a suitable shim thickness of said shim, wherein said tool is comprised of an elongated and tapered sheet with marks along a scale thereon, said sheet is arranged for being snugly inserted between said ring and said finger, and a mark on said scale directly under said ring is for being correlated with an actual gap size and thus said suitable shim thickness.

2. The finger ring shim system of claim 1, wherein said member is oval shaped for comfort.

3. The finger ring shim system of claim 1, wherein said inner side of said member is curved for conforming to a contour of said finger.

4. The finger ring shim system of claim 1, further including slots of graduated widths on said sheet for measuring a width of said ring and determining a suitable width of said groove.

5. A method for securing a loose finger ring on a finger, comprising: wearing said ring on said finger;

providing a shim sizing tool comprising an elongated and tapered sheet with marks along a scale thereon and slots of graduated widths;

inserting said tool snugly between said ring and said finger;

reading an actual gap size at a mark along said scale under said ring;

inserting said ring edgewise into said slots to find a smallest slot which said ring can slip into;

reading a width of said smallest slot to determine a width of said ring;

providing a shim for being wedged between said ring and said ringer, wherein said shim is comprised of an elongated member with a groove on an outer side for cradling said ring, and has a shim thickness generally equal to said gap size, and a groove width generally equal to said width of said ring.

* * * * *